US009580994B2

(12) United States Patent
Flores

(10) Patent No.: US 9,580,994 B2
(45) Date of Patent: Feb. 28, 2017

(54) STRADDLE PACKER EQUALIZATION AND SELF RECOVERY MODULE

(71) Applicant: Baker Hughes Incorporated, Houston, TX (US)

(72) Inventor: Juan Carlos Flores, The Woodlands, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 231 days.

(21) Appl. No.: 14/530,260

(22) Filed: Oct. 31, 2014

(65) Prior Publication Data

US 2016/0123114 A1 May 5, 2016

(51) Int. Cl.

| | |
|---|---|
| ***E21B 33/124*** | (2006.01) |
| ***E21B 34/12*** | (2006.01) |
| ***E21B 43/16*** | (2006.01) |
| ***E21B 23/00*** | (2006.01) |
| *E21B 34/00* | (2006.01) |

(52) U.S. Cl.

CPC ..... *E21B 34/12* (2013.01); *E21B 23/004* (2013.01); *E21B 33/124* (2013.01); *E21B 43/16* (2013.01); *E21B 2034/007* (2013.01)

(58) Field of Classification Search

CPC ..... E21B 23/004; E21B 33/124; E21B 34/12; E21B 43/16; E21B 2034/007

USPC ..... 166/373, 149, 185

See application file for complete search history.

(56) References Cited

U.S. PATENT DOCUMENTS

| | | | | |
|---|---|---|---|---|
| 3,542,126 A * | 11/1970 | Owen | E21B 17/02 166/129 |
| 4,962,815 A * | 10/1990 | Schultz | E21B 23/006 166/127 |
| 2011/0067870 A1* | 3/2011 | East, Jr. | E21B 33/124 166/298 |
| 2014/0246209 A1* | 9/2014 | Themig | E21B 43/14 166/374 |

* cited by examiner

*Primary Examiner* — Taras P Bemko

(74) *Attorney, Agent, or Firm* — Parsons Behle & Latimer

(57) ABSTRACT

A packer that may be used to isolate a portion of a wellbore and a method of using the packer within the wellbore. The packer includes a body with a central bore, an upper sealing element, a lower sealing element, treatment ports, upper equalization ports, and a sleeve positioned within the central bore. The sleeve may be moved to selectively permit fluid communication through the treatment ports and the upper equalization ports. The packer may include lower equalization ports and the sleeve may be moved to also selectively permit fluid communication through the lower equalization ports. The sleeve may include a closed end and an inner wall that separates a secondary cavity from a main cavity. The sleeve includes a plurality of openings that either permits or inhibits fluid communication through the ports of the packer depending on the position of the sleeve within the central bore of the packer.

20 Claims, 7 Drawing Sheets

STRADDLE PACKER EQUALIZATION AND SELF RECOVERY MODULE

FIELD OF THE DISCLOSURE

The embodiments described herein relate to a straddle packer having a movable sleeve within the packer that provides various flow path configurations within the body of the straddle packer.

BACKGROUND

Description of the Related Art

Straddle packers have been used to isolate a portion of a wellbore. A straddle packer typically includes an upper sealing element, a lower sealing element, and a communication port between the packers. The sealing elements may be mechanically or hydraulically actuated to create upper and lower seals isolating a portion of the wellbore. While the wellbore is isolated, the wellbore formation may be treated by pumping fluid out the port between the sealing elements.

After the formation has been treated, it may be desired to unset the sealing elements and move the packer to a different location with the wellbore. Debris and/or sand within the wellbore may make it difficult to move the packer after unsetting the sealing elements. The sand and/or debris can also make it difficult to unset the sealing elements. Further, a high pressure differential across the sealing elements may also make it difficult to unset the sealing elements of the packer to permit it to be moved to another location.

SUMMARY

The present disclosure is directed to a straddle packer device and method that overcomes some of the problems and disadvantages discussed above. The present disclosure is directed to a packer that permits sand and/or debris to be cleaned away from the sealing devices. The present disclosure is directed to a packer that may also permit the equalization of pressure across the sealing elements.

One embodiment is a packer comprising a body having a central bore, an upper sealing element connected to an exterior of the body, and a lower sealing element connected to the exterior of the body. The packer comprises treatment ports that permit fluid communication between the central bore and the exterior of the body between the upper and lower sealing elements. The packer comprises upper equalization ports that permit fluid communication between the central bore and the exterior of the body above the upper sealing element. The packer comprises a sleeve positioned within the central bore. The sleeve may be moved to selectively permit fluid communication through the treatment ports and the upper equalization ports.

The sleeve may comprise a closed end and an inner wall that separates a secondary cavity from a main cavity within the sleeve. The secondary cavity may be in fluid communication with an exterior of the sleeve through two openings in the sleeve. The packer may comprise an indexing mechanism connected to the sleeve configured to permit the selective movement of the sleeve within the central bore. The indexing mechanism may be a j-slot track or a ratchet. The packer may comprise a lower equalization port that permits fluid communication between the central bore and the exterior of the body below the lower sealing element. The sleeve may be moved to selectively permit fluid communication through the lower equalization port.

The sleeve may be moved to a first position that permits fluid communication through the treatment ports and inhibits fluid communication through the upper and lower equalization ports. The sleeve may be moved to a second position that permits fluid communication through at least one upper equalization port and through at least one lower equalization port and connects at least one lower equalization port with at least one treatment port via the secondary cavity. The sleeve may be moved to a third position that permits fluid communication through the upper equalization ports and inhibits fluid communication through the treatment ports and lower equalization ports. The sleeve may be moved to a fourth position that inhibits fluid communication through the lower equalization ports, permits fluid communication through at least one treatment port, and connects at least one treatment port with at least one upper equalization port via the secondary cavity. The indexing mechanism may be positioned within the central bore below the sleeve. The indexing mechanism may be positioned within the central bore above the upper sealing element.

The sleeve may be moved to a first position that permits fluid communication through the treatment ports and inhibits fluid communication through the upper equalization ports. The sleeve may be moved to a second position that permits fluid communication through the upper equalization ports and inhibits fluid communication through the treatment ports. The sleeve may be moved to a third position that permits fluid communication through the treatment and upper equalization ports. The sleeve may be moved to a fourth position that permits fluid communication through at least one treatment port and connects at least one treatment port with at least one upper equalization port via the secondary cavity. The sleeve may be moved to a fifth position that provides communication between the treatment ports and portion of the central bore beneath the closed end of the sleeve.

One embodiment is a method of isolating a portion of a wellbore comprising positioning a packer adjacent a portion of a wellbore, the packer comprising a body having a central bore, an upper sealing element connected to an exterior of the body, a lower sealing element connected to the exterior of the body, and a movable sleeve positioned within the central bore. The method comprises isolating a portion of the wellbore by engaging the wellbore with the upper sealing element and engaging the wellbore with the lower sealing element. The method comprises positioning the sleeve at a first position, wherein the sleeve permits fluid communication from the central bore with the exterior of the body through treatment ports positioned between the upper and lower sealing elements.

The method may include treating the portion of the wellbore by pumping fluid from the central bore through the treatment ports. Positioning the sleeve at the first position may comprise moving a portion of the body within an indexing mechanism. The method may comprise positioning the sleeve at a second position. The sleeve at the second position may permit fluid communication through at least one upper and at least one lower equalization ports and creates a flow path between at least one lower equalization port and at least one treatment port through a secondary cavity. The sleeve in the second position may permit fluid communication through upper equalization ports and inhibit fluid communication through the treatment ports. The method may comprise pumping fluid down the central bore, through the upper equalization ports, and up the exterior of the body.

The method may comprise positioning the sleeve at a third position. The sleeve at the third position may permit fluid communication through the upper equalization ports and inhibit fluid communication through the treatment and lower equalization ports. The method may comprise pumping fluid down the central bore, through the upper equalization ports, and up the exterior of the body. The sleeve at the third position may permit fluid communication through the upper equalization ports and at least one treatment port.

The method may comprise positioning the sleeve at a fourth position. The sleeve at the fourth position may inhibit fluid communication through the lower equalization ports, permit fluid communication through at least one treatment port, and create a flow path between at least one treatment port and at least one upper equalization port through a secondary cavity of the sleeve. The method may comprise pumping fluid down the central bore, pumping fluid out at least one treatment port, pumping fluid into at least one treatment port into the flow path and out at least one upper equalization port, and pumping fluid up the exterior of the body from the at least one upper equalization port. The sleeve at the fourth position may permit fluid communication through at least one treatment port to the exterior and create a flow path between at least one treatment port and at least one upper equalization port through a secondary cavity of the sleeve. The method may comprises pumping fluid down the central bore, pumping fluid out at least one treatment port, pumping fluid into at least one treatment port into the flow path and out at least one upper equalization port, and pumping fluid up the exterior of the body from the at least one upper equalization port. The method may comprise moving the sleeve to a fifth position, wherein at the fifth position the sleeve inhibits fluid communication through the upper equalization ports and permits fluid communication through the treatment ports, the fluid communication being between the exterior of the body and a portion of the central bore below the sleeve.

Figure 1:
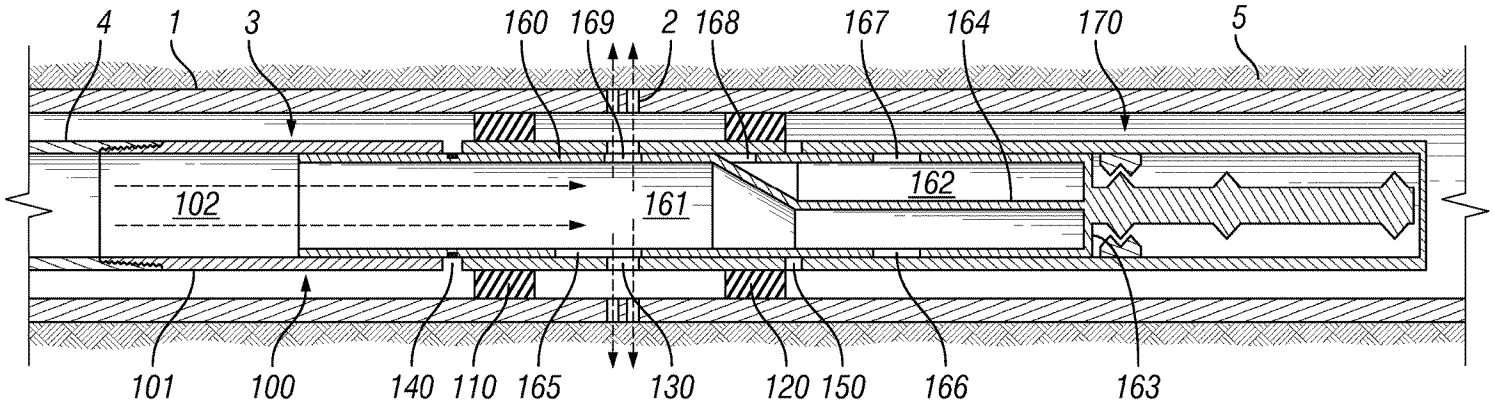
FIG. 1 shows one embodiment of a straddle packer having a sleeve in a first position.

While the disclosure is susceptible to various modifications and alternative forms, specific embodiments have been shown by way of example in the drawings and will be described in detail herein. However, it should be understood that the disclosure is not intended to be limited to the particular forms disclosed. Rather, the intention is to cover all modifications, equivalents and alternatives falling within the scope of the disclosure as defined by the appended claims.

DETAILED DESCRIPTION

FIG. 1 shows an embodiment of a packer 100 positioned within casing 1 of a wellbore. The casing 1 includes perforations 2 that permit the treatment of a formation 5 adjacent to the perforations 2. The treatment of the formation 5 through the perforations 2 may include various procedures. For example, the treatment may include chemical stimulation, fracturing, and/or re-fracturing as would be appreciated by one of ordinary skill in the art having the benefit of this disclosure. The packer 100 is conveyed into the wellbore via tubing 4, which may be coiled tubing or jointed tubing. The tubing 4 is connected to an upper portion of a body 101 of the packer 100. An upper sealing element 110 and a lower sealing element 120 are connected to the exterior of the body 101. The upper and lower sealing elements 110 and 120 may each comprise a plurality of sealing elements and may be actuated to be set against the casing 1 to isolate a portion of the wellbore as would be appreciated by one of ordinary skill in the art having the benefit of this disclosure. The upper and lower sealing elements 110 and 120 may be used to isolate a perforation(s) 2 in the casing 1 that permits communication with the wellbore formation 5 adjacent to portion of the wellbore isolated by the sealing elements 110 and 120 as shown in FIG. 1.

The packer body 101 may include a central bore 102 that is in communication with the interior of the tubing 4 used to convey the packer 100 within the wellbore. The packer body 101 may include various ports that permit fluid communication between the central bore 102 of the packer body 101 and the exterior of the packer body 101. The packer body 101 may include treatment ports 130 positioned between the sealing elements 110 and 120, upper equalization ports 140 positioned above the upper sealing element 110, and lower equalization ports 150 positioned below the lower sealing element 120.

The packer 100 may include a sleeve 160 positioned within the central bore 102 of the packer body 101. The sleeve 160 may be moveable between various positions within the packer body 101 to permit selective communication through the various ports 130, 140, and 150 in the packer body 101 as described herein. The sleeve 160 may include a main cavity or bore 161 and a secondary cavity, or bore, 162 that is isolated from the main cavity 161 by an inner wall 164. The lower end of the sleeve 160 may be closed with a wall 163. The sleeve 160 may include a plurality of ports or openings 165-169 that permit selective communication through the various ports or openings 130, 140, and 150 of the packer body 101 depending of the position of the sleeve 160 as described herein. The packer 100 may include an indexing mechanism 170 that is used to selectively position the sleeve 160 in successive positions within the body 101 of the packer 100. Various indexing mechanism may be used to selectively position the sleeve 160 within the body 101 of the packer 100 as would be appreciated by one of ordinary skill in the art having the benefit of this disclosure. For example, the indexing mechanism may be a linear indexing mechanism 170 schematically depicted in FIG. 1 or a j-track slot, schematically depicted as 270 in FIG. 5. The indexing mechanism 170 may be positioned below the sleeve 160.

FIG. 1 shows the sleeve 160 in a first position, or treating position, within the body 101 of the packer 100. In the first position, openings 165 and 169 in the sleeve 160 are at least partially aligned with treatment ports 130 in the packer body 101. Thus, the formation 5 adjacent the perforations 2 in the casing 1 may be treated by the pumping of fluid down the tubing 4 and central bore 102 of the packer 100 and out the sleeve openings 165 and 169 and the treatment ports 130 as indicated by the arrows shown in FIG. 1. The formation could be stimulated, fractured, and/or re-fractured with the sleeve 160 in the first position. The upper and lower sealing elements 110 and 120 isolate the wellbore so that the treatment is limited to the formation adjacent to the perforation(s) 2 in the casing 1. The upper equalization ports 140 and the lower equalization ports 150 are covered by the sleeve 160 while in the first position inhibiting the flow of fluid from the central bore 102 of the packer and the primary bore 161 of the sleeve to the exterior of the packer body 101. As used herein, "inhibiting flow" means any blockage or prevention of flow from complete prevention to partial prevention. As shown in FIG. 1, fluid communication from the interior of the sleeve 160 is inhibited through openings 166-168 when the sleeve 160 is in the first position.

After a particular location of a wellbore has been treated, it may be desirable to disengage the sealing elements 110 and 120 of the packer 100 from the casing 1 and move the packer 100 to another location to be isolated and treated. As discussed above, it may be beneficial to permit equalization of pressure across the sealing elements 110 and 120 prior to attempting to unset the sealing elements 110 and 120. Likewise, it may be beneficial to conduct a cleaning operation(s) around the exterior of the packer 100 to ensure that the packer 100 may be able to be unset and moved to another location within the wellbore.

Figure 2:
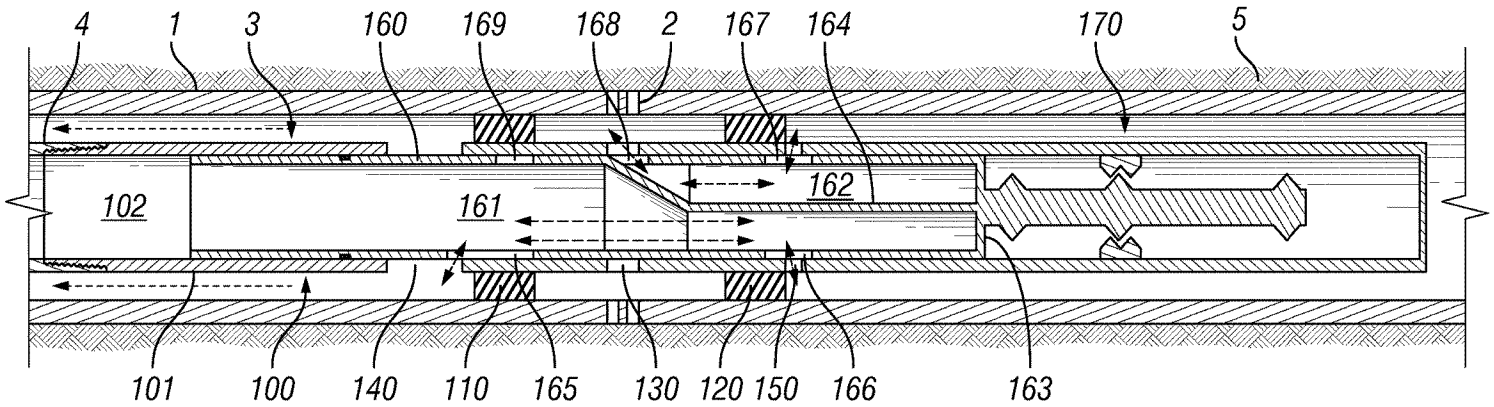
FIG. 2 shows one embodiment of a straddle packer having a sleeve in a second position.

FIG. 2 shows the sleeve 160 moved to a second position, or equalizing position, within the bore 102 of the body 101 of the packer 100. The sleeve 160 may be moved to the second position from the first position by the movement of the tubing 4 attached to the upper end of the packer body 101. For example, the tubing 4 may be pulled uphole with the sealing elements 110 and 120 still set against the casing 1. The indexing mechanism 170 ensures that the sleeve 160 will move from the first position to the second position shown in FIG. 2. In the second position, opening 165 in the sleeve 160 is at least partially aligned with at least one upper equalization port 140 of the packer body 101, which permits fluid communication between the annulus 3 between the exterior of the packer body 101 and the casing 1 above the upper sealing element 110. Likewise, opening 166 in the sleeve 160 is at least partially aligned with at least one lower equalization port 150 of the packer body 101 permitting fluid communication from the interior of the packer 100 and the exterior between the packer body 101 and the casing 1 below the lower sealing element 120.

Opening 167 of the sleeve 160 may be at least partially aligned with at least one lower equalization port 150 and opening 168 of the sleeve 160 may be at least partially aligned with at least one treatment port 130, which creates a flow path through the secondary cavity 162 of the sleeve 160 from the exterior of the packer body 101 below the lower sealing element 120 and the exterior of the packer body 101 between the sealing elements 110 and 120. Thus, in the second position the openings 165-168 permit the equalization of pressure above and below each of the sealing elements 110 and 120 of the packer 100 as shown by the arrows in FIG. 2. In the second position, the packer body 101 may inhibit fluid flow through opening 169 of the sleeve 160.

Figure 3:
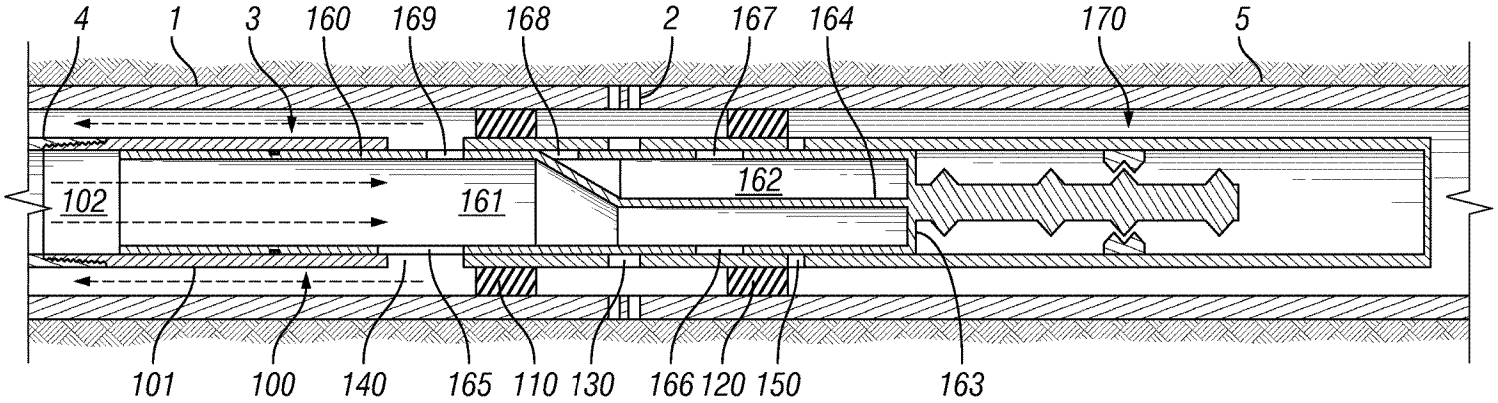
FIG. 3 shows one embodiment of a straddle packer having a sleeve in a third position.

After the pressures have been equalized above and below each of the sealing elements 110 and 120, the tubing 4 may be pulled again to move the sleeve 160 to a third, or cleaning, position via the indexing mechanism 170. The openings 165 and 169 of the sleeve 160 are at least partially aligned with the upper equalization ports 140 in the body 101 of the packer 100 as shown in FIG. 3. The alignment of the openings 165 and 169 with the upper equalization ports 140 permits fluid to be pumped down the tubing 4 and out the aligned ports 165, 169, and 140 and up the annulus 3 between the exterior of the packer body 101 and the casing 1 as shown by the arrows in FIG. 3. The procedure may be used to clean out sand and/or debris positioned in the annulus above the upper sealing element 110. In the third position, the sleeve 160 inhibits flow through the treatment ports 130 and lower equalization ports 150 as well as through openings 166-168 in the sleeve 160.

Figure 4:
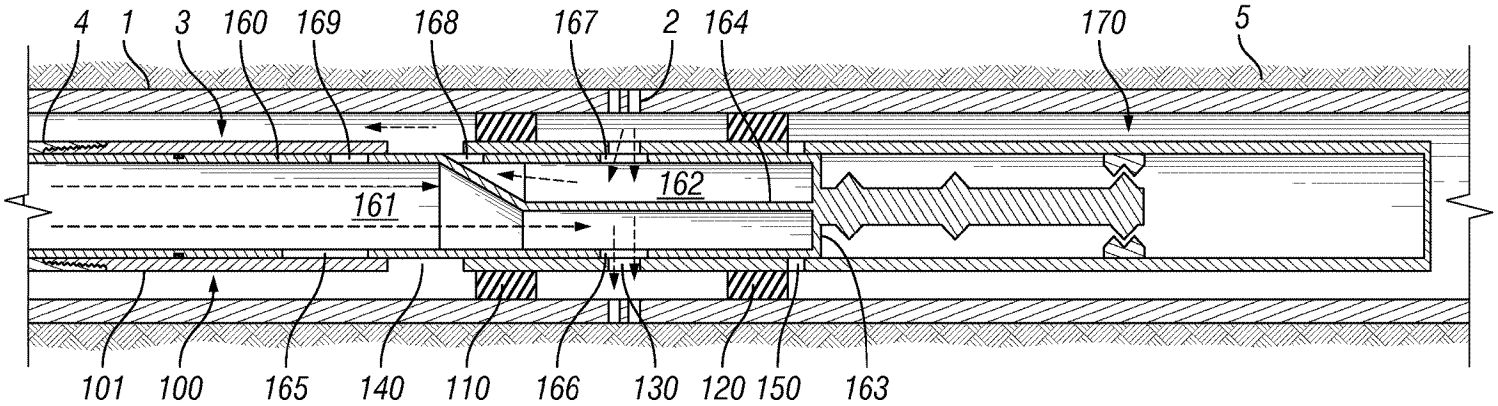
FIG. 4 shows one embodiment of a straddle packer having a sleeve in a fourth position.

The sleeve 160 may be moved to a fourth, or self-cleaning, position by pulling on the tubing 4 to actuate the indexing mechanism 170. In the fourth position, the sleeve 160 creates a flow path from the tubing 4, the bore 102 of the packer, and the primary cavity 161 of the sleeve to the annulus 3 above the upper sealing element 110 via a flow path through the secondary cavity 162 of the sleeve 160. The primary cavity 161 is in fluid communication with the exterior of the body 101 between the sealing element 110 and 120 via at least one treatment port 130 and opening 166 of the sleeve 160. The secondary cavity 162 is in fluid communication with the exterior of the packer between the isolation elements via at least one treatment port 130 and opening 167. The second cavity 162 is also in fluid communication with the annulus 3 above the upper sealing element 110 via at least one upper equalization port 140 and opening 168 in the sleeve. Thus, fluid may be circulated down the tubing 4, through the packer body 101, and up the annulus 3 as indicated by arrows shown in FIG. 4.

Figure 5:
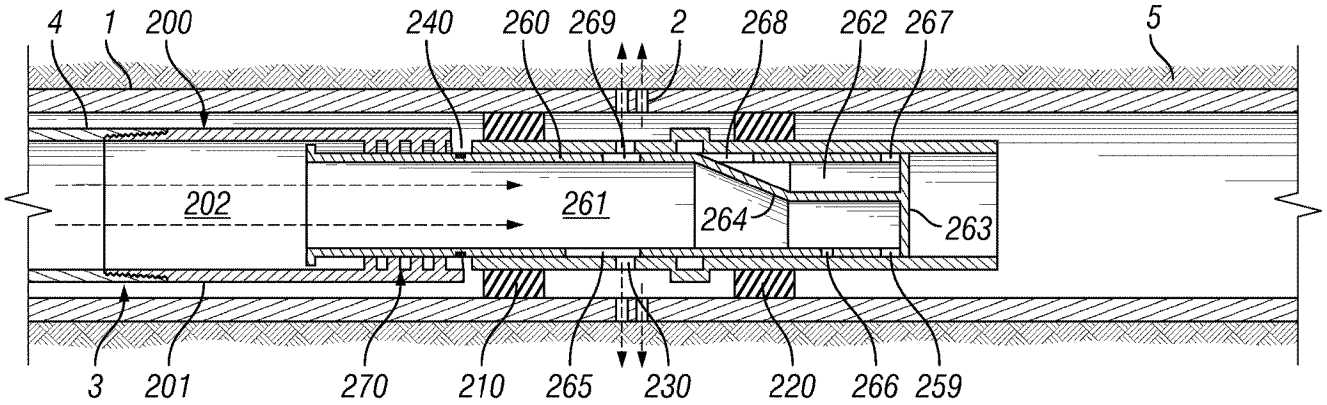
FIG. 5 shows one embodiment of a straddle packer having a sleeve in a first position.

FIG. 5 shows an embodiment of a packer 200 positioned within casing 1 of a wellbore. The casing 1 includes perforations 2 that permit the treatment of a formation 5 adjacent to the perforations 2. The treatment of the formation 5 through the perforations 2 may include various procedures. For example, the treatment may include chemical stimulation, fracturing, and/or re-fracturing as discussed above. The packer 200 may be conveyed into the wellbore via tubing 4. The tubing 4 is connected to an upper portion of a body 201 of the packer 200. An upper sealing element 210 and a lower sealing element 220 are connected to the exterior of the body 201. The upper and lower sealing elements 210 and 220 may each comprise a plurality of sealing elements and may be actuated to be set against the casing 1 to isolate a portion of the wellbore as would be appreciated by one of ordinary skill in the art having the benefit of this disclosure. The upper and lower sealing elements 210 and 220 may be used to isolate a perforation(s) 2 in the casing 1 that permits communication with the wellbore formation 5 adjacent to portion of the wellbore isolated by the sealing elements 210 and 220 as shown in FIG. 5.

The packer body 201 may include a central bore 202 that is in communication with the interior of the tubing 4 used to convey the packer 200 within the wellbore. The packer body 201 may include various ports that permit fluid communication between the central bore 202 of the packer body 201 and the exterior of the packer body 201. The packer body 201 may include treatment ports 230 positioned between the sealing elements 210 and 220 and upper equalization ports 240 positioned above the upper sealing element 210.

The packer 200 may include a sleeve 260 positioned within the central bore 202 of the packer body 201. The sleeve 260 may be moveable between various positions within the packer body 201 to permit selective communication through the various ports 230 and 240 in the packer body 201 as described herein. The sleeve 260 may include a main cavity or bore 261 and a secondary cavity, or bore, 262 that is isolated from the main cavity 261 by an inner wall 264. The lower end of the sleeve 260 may be closed with a wall 263. The sleeve 260 may include a plurality of ports or openings 259 and 265-269 that permit selective communication through the various ports or openings 230 and 240 of the packer body 201 depending of the position of the sleeve 260, as described herein. The packer 200 may include an indexing mechanism 270 that is used to selectively position the sleeve 260 in successive positions within the body 201 of the packer 200. The indexing mechanism 270 may be positioned above the sleeve 260. Various indexing mechanism may be used to selectively position the sleeve 260 within the body 201 of the packer 200 as would be appreciated by one of ordinary skill in the art having the benefit of this disclosure.

FIG. 5 shows the sleeve 260 is a first position, or treating position, within the body 201 of the packer 200. In the first position, openings 265 and 269 in the sleeve 260 are at least partially aligned with treatment ports 230 in the packer body 201. Thus, the formation 5 adjacent the perforations 2 in the casing 1 may be treated by the pumping of fluid down the tubing 4 and central bore 202 of the packer 200 and out the sleeve openings 265 and 269 and the treatment ports 230 as indicated by the arrows shown in FIG. 5. The formation could be stimulated, fractured, and/or re-fractured with the sleeve 260 in the first position. The upper and lower sealing elements 210 and 220 isolate the wellbore so that the treatment is limited to the formation adjacent to the perforation(s) 2 in the casing 1. The upper equalization ports 240 are covered by the sleeve 260 while in the first position inhibiting the flow of fluid from the central bore 202 of the packer 200 and the primary bore 261 of the sleeve 260 to the exterior of the packer body 201. As shown in FIG. 5, fluid communication from the interior of the sleeve 260 is inhibited through openings 259 and 266-268 when the sleeve 260 is in the first position.

After a particular location of a wellbore has been treated, it may be desirable to disengage the sealing elements 210 and 220 of the packer 200 from the casing 1 and move the packer 200 to another location to be isolated and treated. As discussed above, it may be beneficial to permit equalization of pressure across the sealing elements 210 and 220 prior to attempting to unset the sealing elements 210 and 220. Likewise, it may be beneficial to conduct a cleaning operation(s) around the exterior of the packer 200 to ensure that the packer 200 may be able to be unset and moved to another location within the wellbore.

Figure 6:
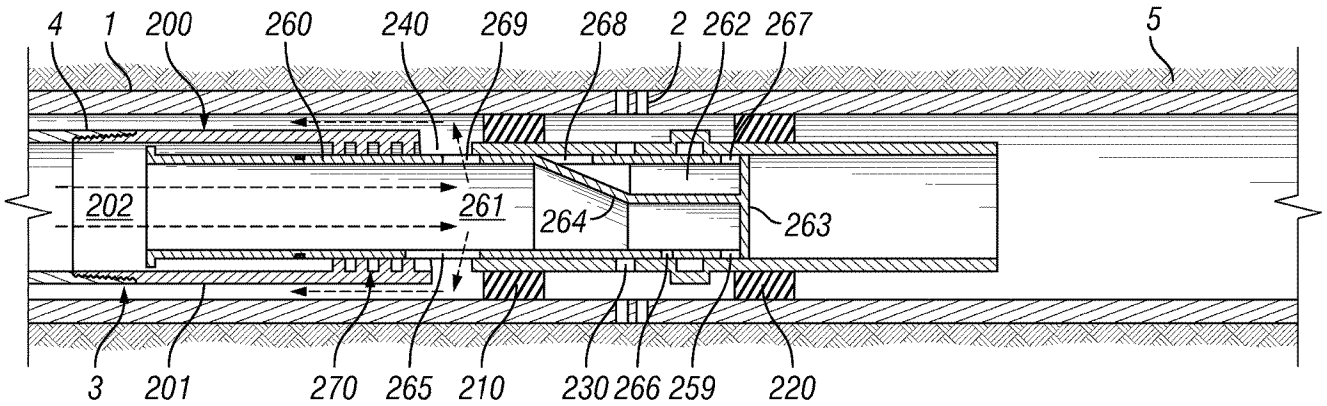
FIG. 6 shows one embodiment of a straddle packer having a sleeve in a second position.

After the formation 5 has been treated, the tubing 4 may be pulled to move the sleeve 260 to a second, or cleaning, position via the indexing mechanism 270. The openings 265 and 269 of the sleeve 260 are at least partially aligned with the upper equalization ports 240 in the body 201 of the packer 200 as shown in FIG. 6. The alignment of the openings 265 and 269 with the upper equalization ports 240 permits fluid to be pumped down the tubing 4 and out the aligned ports 265,269, and 240 and up the annulus 3 between the exterior of the packer body 201 and the casing 1 as shown by the arrows in FIG. 6. The procedure may be used to clean out sand and/or debris positioned in the annulus above the upper sealing element 210. In the second position, the sleeve 260 inhibits flow through the treatment ports 230 as well as through openings 259 and 266-268 in the sleeve 260.

Figure 7:
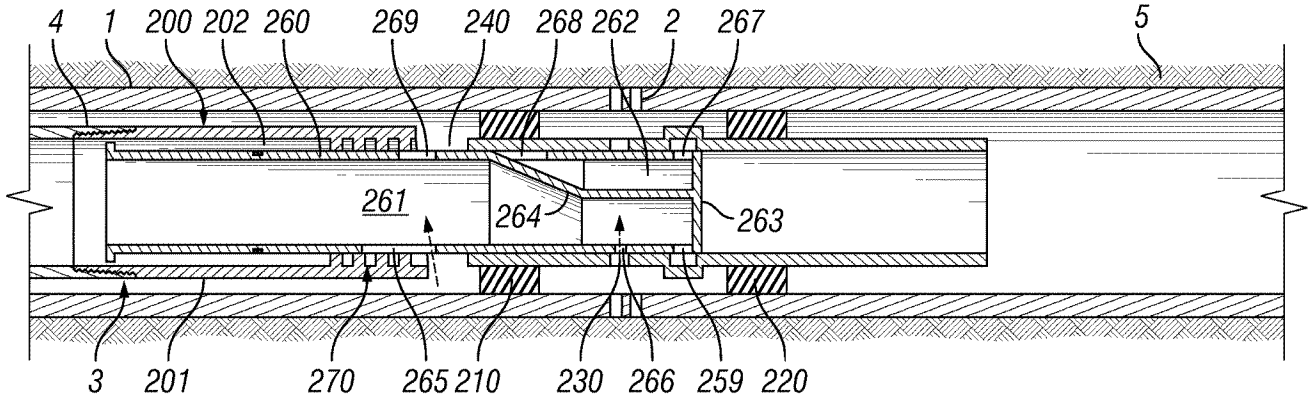
FIG. 7 shows one embodiment of a straddle packer having a sleeve in a third position.

FIG. 7 shows the sleeve 260 moved to a third, or equalizing, position within the bore 202 of the body 201 of the packer 200. The sleeve 260 may be moved to the third position from the second position by the movement of the tubing 4 attached to the upper end of the packer body 201. For example, the tubing 4 may be pulled uphole with the sealing elements 210 and 220 still set against the casing 1. The indexing mechanism 270 ensures that the sleeve 260 will move from the second position to the third position shown in FIG. 7. In the third position, openings 265 and 269 in the sleeve 160 are at least partially aligned with the upper equalization ports 240 of the packer body 201, which permits fluid communication between the annulus 3 between the exterior of the packer body 201 and the casing 1 above the upper sealing element 210. Likewise, opening 266 in the sleeve 260 is at least partially aligned with at least one treatment port 230 of the packer body 201 permitting fluid communication from the interior of the packer 200 and the exterior between the packer body 201 and the casing 1 between the sealing elements 210 and 220.

Figure 8:
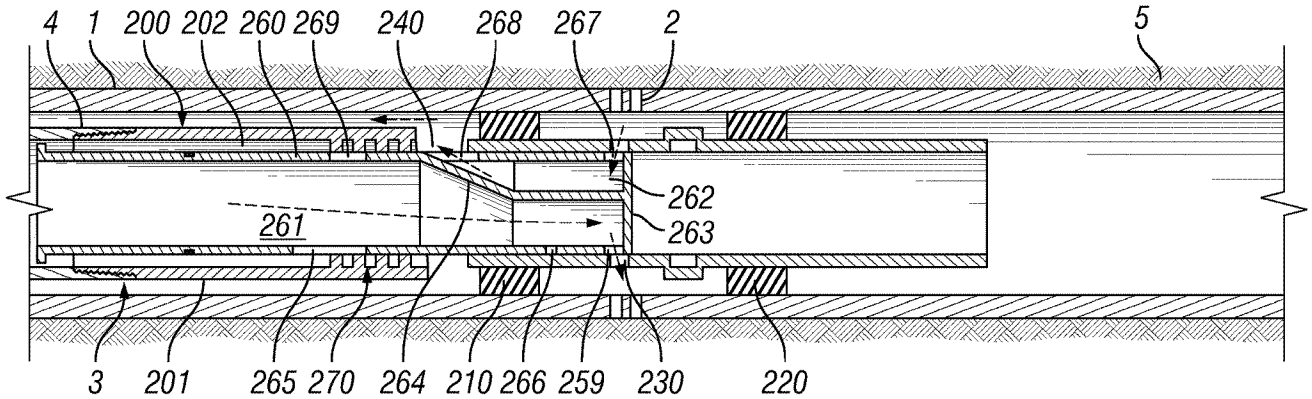
FIG. 8 shows one embodiment of a straddle packer having a sleeve in a fourth position.

The sleeve 260 may be moved to a fourth, or self-cleaning, position by pulling on the tubing 4 to actuate the indexing mechanism 270. In the fourth position, the sleeve 260 creates a flow path from the tubing 4, the bore 202 of the packer, and the primary cavity 261 of the sleeve 260 to the annulus 3 above the upper sealing element 210 via a flow path through the secondary cavity 262 of the sleeve 260. The primary cavity 261 is in fluid communication with the exterior of the body 201 between the sealing element 210 and 220 via at least one treatment port 230 and opening 259 of the sleeve 260. The secondary cavity 262 is in fluid communication with the exterior of the packer 200 between the isolation elements 210 and 220 via at least one treatment port 230 and opening 267. The second cavity 262 is also in fluid communication with the annulus 3 above the upper sealing element 210 via at least one upper equalization port 240 and opening 268 in the sleeve. Thus, fluid may be circulated down the tubing 4, through the packer body 201, and up the annulus 3 as indicated by arrows shown in FIG. 8.

Figure 9:
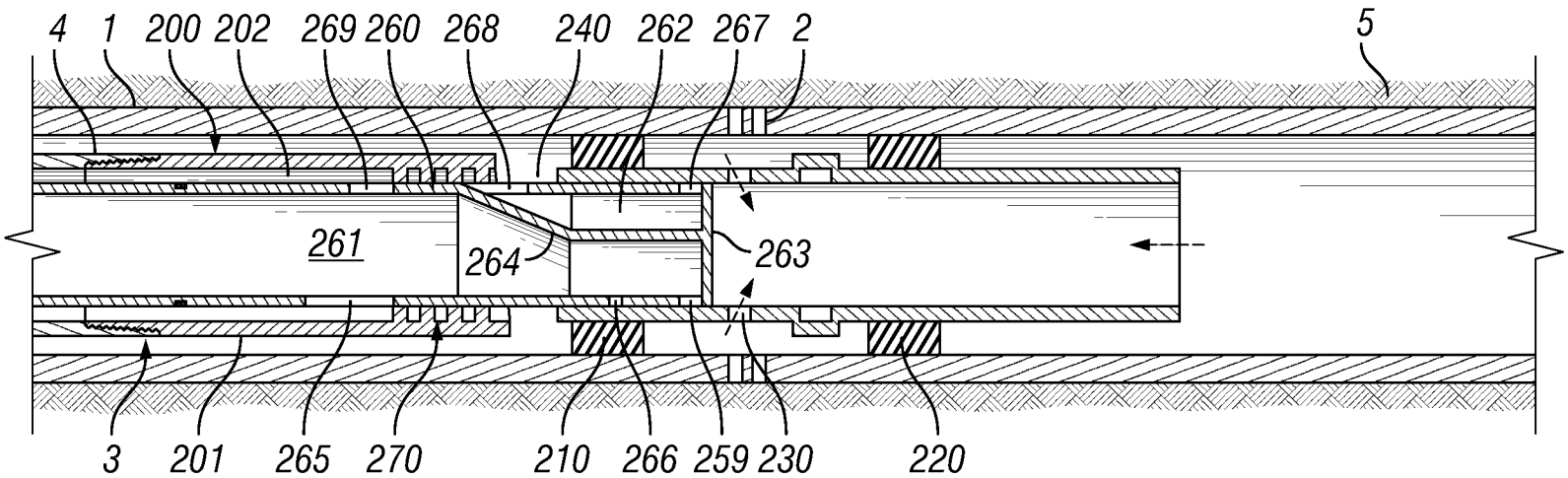
FIG. 9 shows one embodiment of a straddle packer having a sleeve in a fifth position.

After the self-cleaning operation, the sleeve 260 may be moved to a fifth position within the packer 200 as shown in FIG. 9. In the fifth position, the end of the sleeve 260 is moved above the treatment ports 230 of the packer body 201. This permits the equalization of pressure in the annulus between the sealing elements 210 and 220 with the wellbore pressure below the lower sealing element 210 via the central bore 202 of the packer body 201. After equalization of pressure the packer 200 may be moved to another portion within the wellbore to be isolated and treated.

Figure 10:
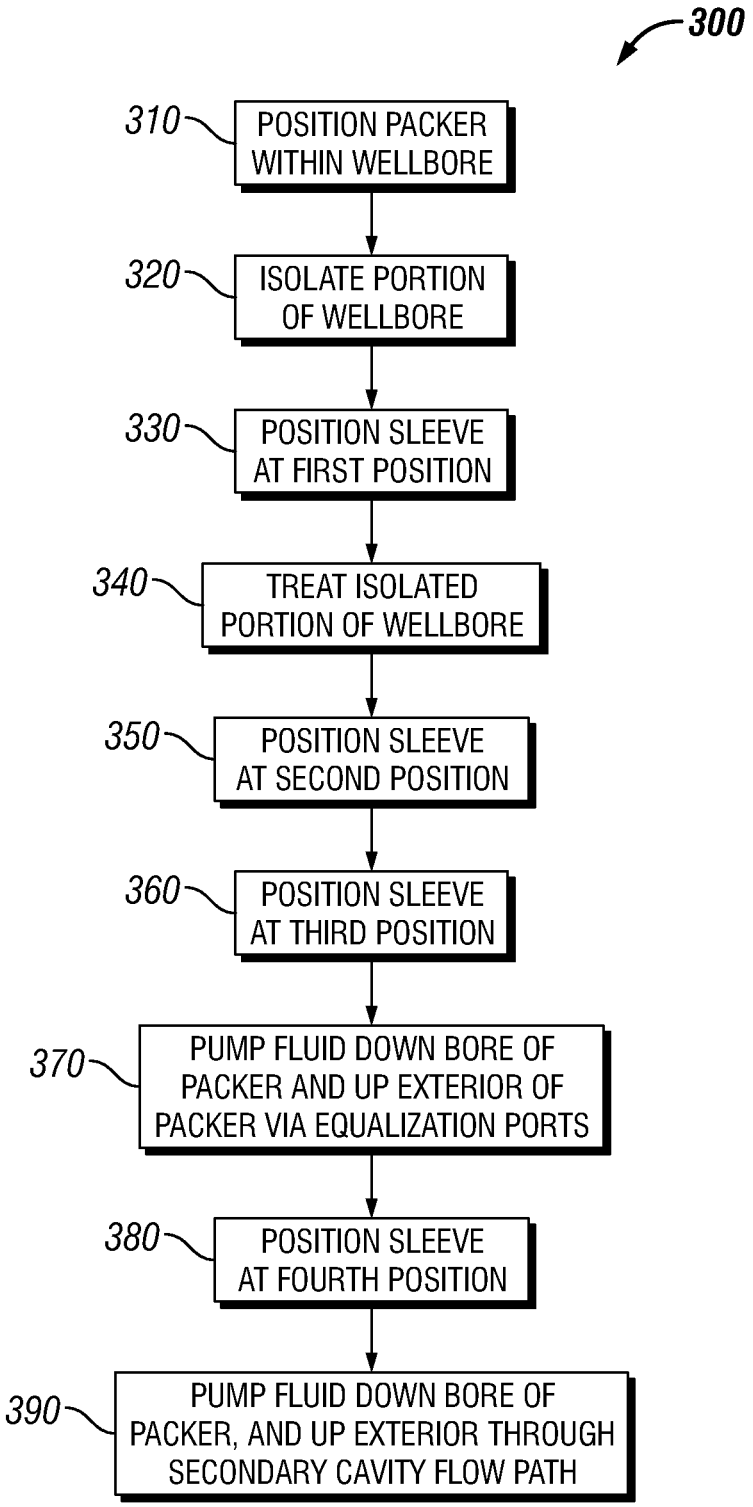
FIG. 10 shows a flow chart of one embodiment of a isolating a portion of a wellbore.

FIG. 10 shows a flow chart for one method 300 of isolating a portion of a wellbore. In step 310, a packer is positioned within a portion of a wellbore and the portion is isolated in step 320. A sleeve within the packer is moved to a first position within the packer 330. The sleeve may be moved to the first position prior to locating the packer at the position with the wellbore. The sleeve permits the treatment of the isolated portion of the wellbore in step 340. After treating the wellbore, the sleeve is moved to a second position within the wellbore in step 350. The sleeve in the second position may permit the equalization of pressure of the sealing elements of the packer. The sleeve may be moved to a third position in step 360 of the method 300. In the third position, fluid may be pumped down tubing and out the packer to circulate sand and/or debris up the annulus between the tubing and the packer in step 370. The sleeve may then be moved to a fourth position within the packer in step 380. While the sleeve is in the fourth position, fluid may be pumped down through the packer and up the annulus in step 390.

Figure 11:
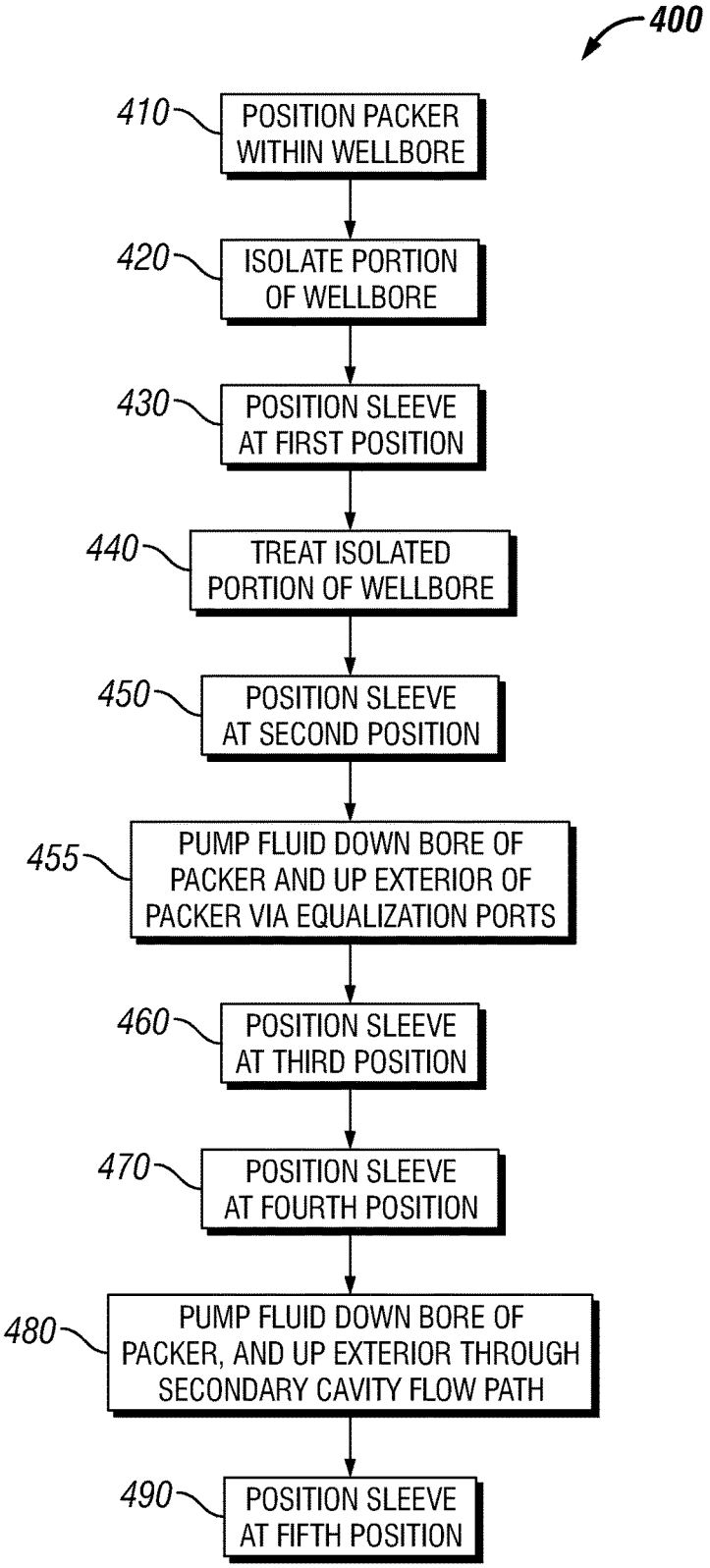
FIG. 11 shows a flow chart of one embodiment of a isolating a portion of a wellbore.

FIG. 11 shows a flow chart for one method 400 of isolating a portion of a wellbore. In step 410, a packer is positioned within a portion of a wellbore and the portion is isolated in step 420. A sleeve within the packer is moved to a first position within the packer 430. The sleeve may be moved to the first position prior to locating the packer at the position with the wellbore. The sleeve permits the treatment of the isolated portion of the wellbore in step 440. After treating the wellbore, the sleeve is moved to a second position within the wellbore in step 450. While the sleeve is in the second position, fluid may be pumped down the bore of the packer and up the exterior of the packer in step 455.

The sleeve may be moved to a third position in step 460 of the method 400. With the sleeve in the third position, pressure may be equalized above the upper sealing element and between the sealing elements. The sleeve may then be moved to a fourth position within the packer in step 470. While the sleeve is in the fourth position, fluid may be pumped down through the packer and up the annulus in step 480. The sleeve may be then moved to a fifth position within the packer in step 490. The sleeve in the fifth position may permit the equalization of pressure above and below the lower sealing element.

Although this disclosure has been described in terms of certain preferred embodiments, other embodiments that are apparent to those of ordinary skill in the art, including embodiments that do not provide all of the features and advantages set forth herein, are also within the scope of this disclosure. Accordingly, the scope of the present disclosure is defined only by reference to the appended claims and equivalents thereof.

What is claimed is:

1. A packer comprising:

a body having a central bore;

an upper sealing element connected to an exterior of the body;

a lower sealing element connected to the exterior of the body;

a treatment port, the treatment port permitting fluid communication between the central bore and the exterior of the body between the upper and lower sealing elements;

an upper equalization port, the upper equalization port permitting fluid communication between the central bore and the exterior of the body above the upper sealing element; and a sleeve positioned within the central bore, wherein the sleeve may be moved to selectively permit fluid communication through the treatment port and the upper equalization port, the sleeve comprises a closed end and an inner wall that separates a secondary cavity from a main cavity within the sleeve, the secondary cavity in fluid communication with an exterior of the sleeve through at least one opening in the sleeve.

2. The packer of claim 1, wherein the secondary cavity in fluid communication with an exterior of the sleeve through two openings in the sleeve.

3. The packer of claim 2, wherein the treatment port further comprises a plurality of treatment ports and the upper equalization port further comprises a plurality of upper equalization ports and wherein the sleeve may be moved between a first position that permits fluid communication through the treatment ports and inhibits fluid communication through the upper equalization ports; a second position that permits fluid communication through the upper equalization ports and inhibits fluid communication through the treatment ports; a third position that permits fluid communication through the treatment and upper equalization ports; a fourth portion that permits fluid communication through at least one treatment port and connects at least one treatment port with at least one upper equalization port via the secondary cavity; and a fifth position that provides communication between the treatment ports and a portion of the central bore beneath the closed end of the sleeve.

4. The packer of claim 1, further comprising a lower equalization port, the lower equalization port permitting fluid communication between the central bore and the exterior of the body below the lower sealing element, and wherein the sleeve may be moved to selectively permit fluid communication through the lower equalization port and wherein the treatment port further comprises a plurality of treatment ports, the upper equalization port further comprises a plurality of upper equalization ports, and the lower equalization port further comprises a plurality of lower equalization ports.

5. The packer of claim 4, wherein the sleeve may be moved between a first position that permits fluid communication through the treatment ports and inhibits fluid communication through the upper and lower equalization ports; a second position that permits fluid communication through at least one upper equalization port and through at least one lower equalization port and connects at least one lower equalization port with at least one treatment port via the secondary cavity; a third position that permits fluid communication through the upper equalization ports and inhibits fluid communication through the treatment ports and lower equalization ports; and a fourth position that inhibits fluid communication through the lower equalization ports, permits fluid communication through at least one treatment port, and connects at least one treatment port with at least one upper equalization port via the secondary cavity.

6. A method of isolating a portion of a wellbore comprising:

positioning a packer adjacent a portion of a wellbore, the packer comprising a body having a central bore, an upper sealing element connected to an exterior of the body; a lower sealing element connected to the exterior of the body, and a movable sleeve positioned within the central bore;

isolating the portion of the wellbore by engaging the wellbore with the upper sealing element and engaging the wellbore with the lower sealing element;

positioning the sleeve at a first position, wherein the sleeve permits fluid communication from the central bore with the exterior of the body through a treatment port positioned between the upper and lower sealing elements;

treating the portion of the wellbore by pumping fluid from the central bore through the treatment port; and positioning the sleeve at a second position, wherein the treatment port further comprises a plurality of treatment ports and wherein the body further comprises a plurality of upper equalization ports and a plurality of lower equalization ports, wherein the sleeve in the second position permits fluid communication through at least one upper equalization port and at least one lower equalization ports and creates a flow path between at least one lower equalization port and at least one treatment port through a secondary cavity of the sleeve.

7. The method of claim 6, wherein positioning the sleeve at the first position further comprises moving a portion of the body within an indexing mechanism.

8. The method of claim 6, further comprising positioning the sleeve at a third position.

9. The method of claim 8, wherein the sleeve at the third position permits fluid communication through the upper equalization ports and inhibits fluid communication through the treatment and lower equalization ports.

10. The method of claim 9, further comprising pumping fluid down the central bore, through the upper equalization ports, and up the exterior of the body.

11. The method of claim 8, wherein the sleeve at the third position permits fluid communication through the upper equalization ports and at least one treatment port.

12. The method of claim 8, further comprising moving the sleeve to a fourth position.

13. The method of claim 12, wherein at the fourth position the sleeve inhibits fluid communication through the lower equalization ports, permits fluid communication through at least one treatment port, and creates a flow path between at least one treatment port and at least one upper equalization port through a secondary cavity of the sleeve.

14. The method of claim 13, further comprising pumping fluid down the central bore, pumping fluid out at least one treatment port, pumping fluid into at least one treatment port into the flow path and out at least one upper equalization port, and pumping fluid up the exterior of the body from the at least one upper equalization port.

15. The method of claim 12, wherein at the fourth position the sleeve permits fluid communication through at least one treatment port to the exterior and creates a flow path between at least one treatment port and at least one upper equalization port through a secondary cavity of the sleeve.

16. The method of claim 15, further comprising pumping fluid down the central bore, pumping fluid out at least one treatment port, pumping fluid into at least one treatment port into the flow path and out at least one upper equalization port, and pumping fluid up the exterior of the body from the at least one upper equalization port.

17. The method of claim 16, further comprising moving the sleeve to a fifth position, wherein at the fifth position the sleeve inhibits fluid communication through the upper equalization ports and permits fluid communication through the treatment ports, the fluid communication being between the exterior of the body and a portion of the central bore below the sleeve.

18. A packer comprising:

a body having a central bore;

an upper sealing element connected to an exterior of the body;

a lower sealing element connected to the exterior of the body;

a treatment port, the treatment port permitting fluid communication between the central bore and the exterior of the body between the upper and lower sealing elements;

an upper equalization port, the upper equalization port permitting fluid communication between the central bore and the exterior of the body above the upper sealing element;

a sleeve positioned within the central bore, wherein the sleeve may be moved to selectively permit fluid communication through the treatment port and the upper equalization port; and an indexing mechanism connected to the sleeve, the indexing mechanism configured to permit the selective movement of the sleeve within the central bore, wherein the indexing mechanism is positioned within the central bore below the sleeve, or is positioned within the central bore above the upper sealing element.

19. The packer of claim 18, wherein the indexing mechanism further comprises a j-slot track.

20. The packer of claim 18, wherein the indexing mechanism further comprises a ratchet.

* * * * *